United States Patent [19]

Suzaki et al.

[11] Patent Number: 4,552,475

[45] Date of Patent: Nov. 12, 1985

[54] PRINTER CARRIAGE AND HAMMER ASSEMBLY

[75] Inventors: Masayuki Suzaki, Fugisawa; Tetuo Kanno, Atsugi, both of Japan

[73] Assignee: Ricoh Co., Ltd., Tokyo, Japan

[21] Appl. No.: 440,626

[22] Filed: Nov. 10, 1982

Related U.S. Application Data

[62] Division of Ser. No. 201,375, Oct. 27, 1982, abandoned.

[30] Foreign Application Priority Data

Oct. 30, 1979 [JP] Japan ..... 54-150421[U]

[51] Int. Cl.[4] ..... B41J 1/24

[52] U.S. Cl. ..... 400/144.2; 400/208; 400/355; 400/692; 400/157.2

[58] Field of Search ..... 400/144.2, 157.2, 196, 400/196.1, 208, 355, 356, 357, 692, 693, 693.1

[56] References Cited

U.S. PATENT DOCUMENTS

| | | | |
|---|---|---|---|
| 1,958,764 | 5/1934 | Mosfelt et al. | 400/194 |
| 2,782,895 | 2/1957 | Winter et al. | 400/693.1 |
| 3,110,250 | 11/1963 | Fradkin | 400/157.2 X |
| 3,144,821 | 8/1964 | Drejza | 400/157.3 X |
| 3,349,887 | 10/1967 | Goff, Jr. | 400/208 |
| 3,651,916 | 3/1972 | Becchi | 400/144.3 |
| 3,731,781 | 5/1973 | Caudill et al. | 400/208 |
| 3,863,749 | 2/1975 | Perry et al. | 400/208 |
| 3,899,065 | 8/1975 | Brignole | 400/208 |
| 3,904,017 | 9/1975 | Frechette | 400/196.1 |
| 4,003,460 | 1/1977 | Gray et al. | 400/212 |
| 4,010,839 | 3/1977 | Guerrini et al. | 400/208 X |
| 4,020,940 | 5/1977 | Daley et al. | 400/144.2 X |
| 4,046,245 | 9/1977 | Frechette | 400/144.2 X |
| 4,049,109 | 9/1977 | Plaza et al. | 400/144.2 X |
| 4,106,611 | 8/1978 | Suzuki et al. | 400/174 X |
| 4,111,293 | 9/1978 | Kockler et al. | 400/144.2 X |
| 4,130,367 | 12/1978 | Guerrini et al. | 400/195 |
| 4,197,022 | 4/1980 | Dollenmayer | 400/144.2 |

FOREIGN PATENT DOCUMENTS

| | | | |
|---|---|---|---|
| 2718688 | 11/1977 | Fed. Rep. of Germany . | |
| 144958 | 11/1981 | Japan . | |
| 2063173 | 6/1981 | United Kingdom | 400/144.2 |

OTHER PUBLICATIONS

IBM Technical Disclosure Bulletin, "Print Hammer Mechanism", Mathews, vol. 19, No. 9, Feb. 1977, pp. 3245-3246.

*Primary Examiner*—Ernest T. Wright, Jr.
*Attorney, Agent, or Firm*—Oblon, Fisher, Spivak, McClelland & Maier

[57] ABSTRACT

A printer having a type wheel of the daisy wheel type or the like, which is improved to permit an easy position adjustment of constituents of the type wheel driving mechanism, as well as an easy tilting motion of the carriage in relation to the carrier and an easy attaching of the carriage. Also, the shift of the type wheel can be achieved rapidly and with a light force and the ribbon cartridge can be moved with a light force while suppressing generation of noise.

9 Claims, 23 Drawing Figures

Fig. 1(a)
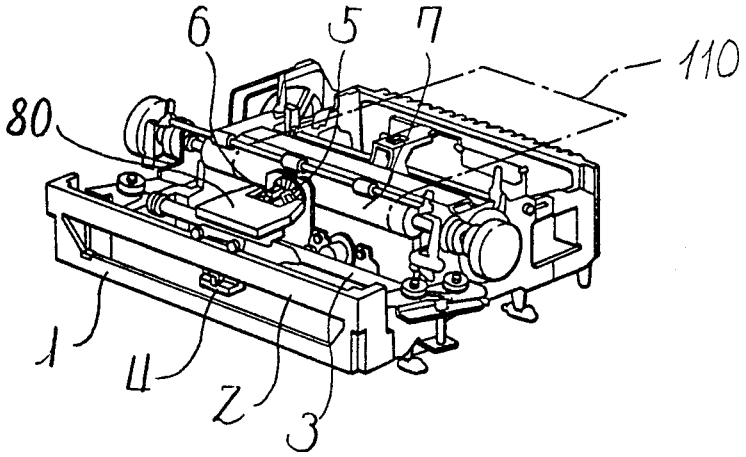
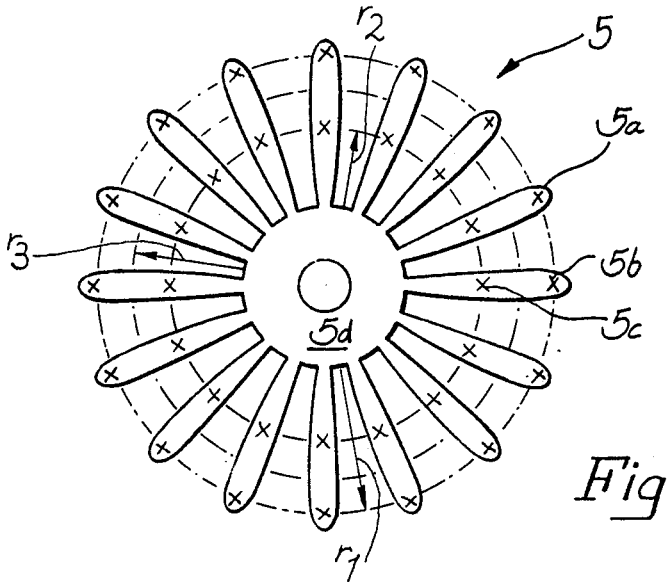
Fig. 1(b)

Fig. 14(a)
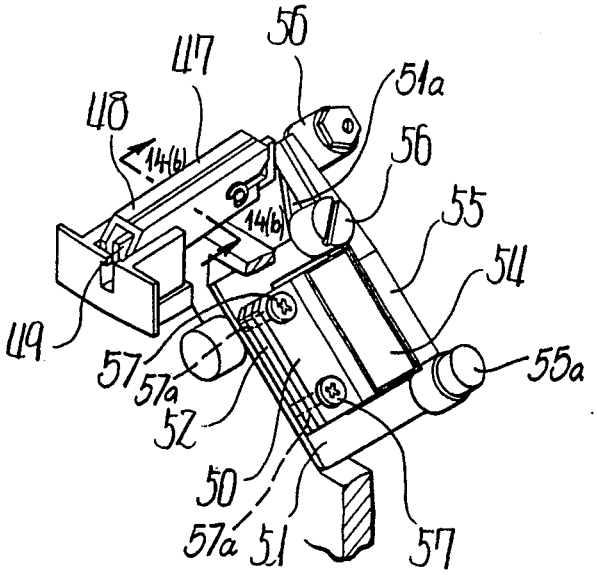
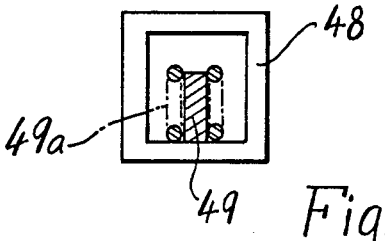
Fig. 14(b)

PRINTER CARRIAGE AND HAMMER ASSEMBLY

This is a division, of application Ser. No. 201,375, filed Oct. 27, 1980 now abandoned.

BACKGROUND OF THE INVENTION

1. Field of the Invention

The present invention relates to a printer and, more particularly, to a printer incorporating a daisy type wheel and other associated parts.

2. Description of the Prior Art

The printer of this type proposed hitherto incorporates a hammer opposing a type head and a magnet for actuating the hammer. The armature of the hammer is required to operate with a predetermined constant stroke. A plurality of parts such as the hammer, hammer frame, armature, magnet and so forth are necessary for achieving such function of the hammer. Although a stopper for limiting the stroke of the armature is disposed in an adjustable manner, there are a plurality of points of adjustment for these parts, and these points of adjustment are related to one another to make the adjusting work troublesome and difficult. Major points of adjustment are, for instance, the position of the hammer relative to the type head, stroke of the hammer, position of the hammer in relation to the armature, range of operation of the hammer, position of the magnet in relation to the armature and so forth. Therefore, in the conventional printer, the adjustment of the hammer actuating mechanism constitutes a bottleneck in the assembling process.

In the conventional magnet device for actuating the hammer, there is provided an armature for imparting driving power to the other parts of the device. This armature is attached to a substrate to which a coil wound around a core is secured. Thus, the magnet device is constituted by the substrate, coil and the armature which are integrated by bolts or like means. Therefore, highly troublesome work is required for setting the positions of these parts in relation to the others. In the case where a stopper is provided for setting the position of the armature and the range of rotation of the same, the adjustment of the stopper poses another problem.

Furthermore, in the printer incorporating a daisy type wheel, types are arranged on two concentric circles to provide printing of characters the number of which is twice as large as the number of fingers, by changing the position of the type wheel in relation to the hammer. In this case, the drive shaft to which the type wheel is secured is coupled to a motor through a universal joint to permit the displacement of the drive shaft axis, and an arm is connected at its one end to the drive shaft while the arm is positioned horizontally and rotatably held at its base portion. A pair of magnets disposed above and below the arm are selectively energized to rotate the arm to thereby shift the type head up and down. In order to bias the arm to the neutral position, two coiled springs are stretched and connected to the upper and lower sides of the arm.

Since these coiled springs are required to exert a certain tensile force even when the arm is rotated, these coiled springs are held in the stretched condition when the arm takes the neutral position. Thus, the setting of the arm at the neutral position is made more difficult due to fluctuation of the coiled springs. In order to avoid the influence on the shifting characteristic, it is necessary to utilize a step of making adjustment, in the assembling process. When the arm is rotated, the force for biasing the arm is materially given by these two coiled springs. Although the spring forces act to negate each other, the spring constants are added to each other to increase the rate of change of load in relation to the deflection amount. This in turn requires a magnet having a capacity large enough to drive this arm.

In the printer having having a daisy type wheel, a carriage by which the type head is carried is held in such a manner as to be able to pivot or tilt, to thereby facilitate the replacement of the type head. Hitherto, there have been two types of holding mechanisms for holding the type wheel: namely a mechanism of the type in which the operative position and release position are set manually by means of a lever and a latch and a mechanism of the type in which the carriage is set either at the operative position or release position by means of a toggle mechanism. In the first mentioned type, a serious accident may occur when the operator forgets to manually lock the type head after the attaching of the same, so that great care is required in the use thereof. In the second mentioned type, although the carriage can be set by a simple operation of making the carriage pivot or tilt, the carriage is liable to be floated or displaced or oscillated during use by the vibration and impact generated at the same of printing, because the carriage in the set position is held solely by the toggle spring.

From another point of view, in the printer having a daisy or like type wheel mounted replaceably, the carriage held by a carrier and adapted to utilize a reciprocating motion is mounted so as to be able to pivot or tilt, and a fulcrum of rotation is formed on the carriage. In addition, the carriage must be precisely located also in the direction of the reciprocating motion. Therefore, in the conventional printer, both side surfaces of the carriage are polished to provide a highly precise distance between both side surfaces so that assembly is performed with high precision making use of these side surfaces as the reference surface. Therefore, it is necessary to machine the main body with high precision. In addition, the mounting of the carriage on the carrier has to be performed by axially aligning two shafts projecting inwardly from the carrier. It is often experienced that the smooth rotation of the carriage fails due to a misalignment of the axes or a local contact between the carriage and the carrier.

In the conventional printer having a type head, a ribbon cartridge containing an ink ribbon is detachably secured to the carriage carrying the type head. In order to enable the operator to visibly check the character immediately after the printing, the ink ribbon is raised to the printing position only during the printing, while it is lowered when printing is not occuring. Hitherto, this function has been achieved by allowing a mounting plate, to which the ribbon cartridge is attached, to tilt vertically within a predetermined range of angle. The attaching plate, however, has a considerably large weight, so that the device for causing the vertical tilting motion of the attaching plate is required to have a large power. In addition, the attaching plate having the large weight generates a vibration of large magnitude during the operation thereof.

SUMMARY OF THE INVENTION

It is, therefore, a first object of the invention to provide a printer having a comparatively simple construction and which is capable of high-speed operation.

It is a second object of the invention to facilitate the position setting of the hammer and other movable parts for actuating the type head.

It is a third object of the invention to facilitate the determination of relative positions of constituents of the magnet device for the hammer, as well as fine adjustment of positions of the same.

It is a fourth object of the invention to make it possible to effect the shifting of the type head with a reduced force and to eliminate the necessity for the adjustment during the assembling.

It is a fifth object of the invention to facilitate the pivoting or tilting operation of the carriage and to enhance the stability of the carriage at the time of setting the carriage in an operational position.

It is a sixth object of the invention to stably secure the carriage, eliminating lateral oscillation of the same, without necessitating the highly precise machining of the same.

It is a seventh object of the invention to permit the ribbon cartridge to be held in such a manner as to be able to move rapidly, with a reduced generation of vibration and with high durability.

BRIEF DESCRIPTION OF THE DRAWING

Various other objects, features and attendant advantages of the present invention will be more fully appreciated as the same becomes better understood from the following detailed description when considered in connection with the accompanying drawing in which like reference characters designate like or corresponding parts throughout the several views and wherein:

FIG. 1(*a*) is a perspective view of a printer;

FIG. 1(*b*) is a plan view of a daisy type wheel;

FIG. 14(*a*) is a perspective view of a hammer assembly;

FIG. 14(*b*) is a sectional view of the hammer assembly depicting a hammer biasing means taken along line 14(*b*)—14(*b*) in FIG. 14(*a*);

DETAILED DESCRIPTION OF THE PREFERRED EMBODIMENT

Figure 2:
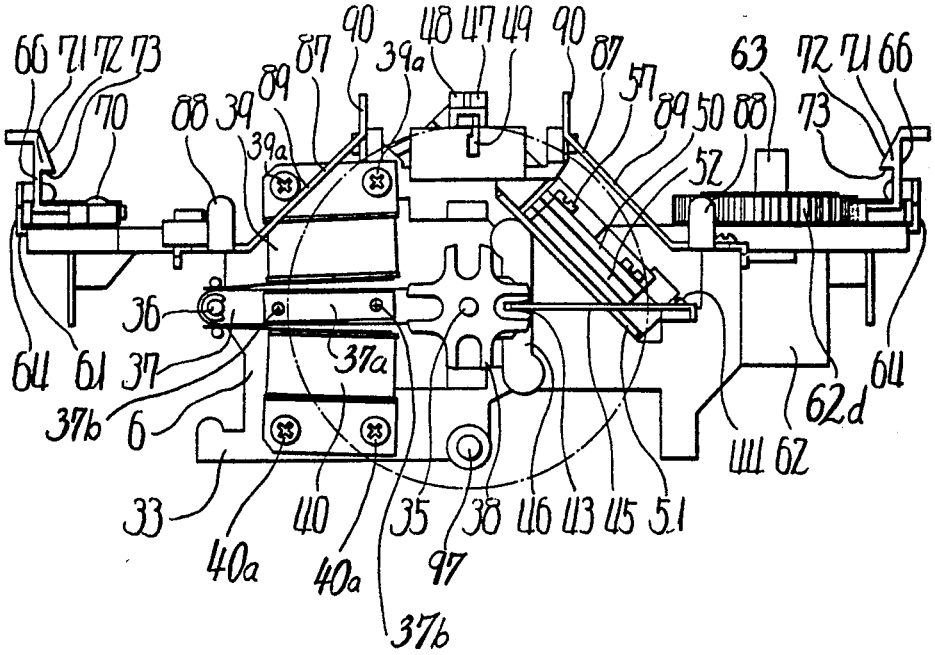
FIG. 2 is a front elevational view of a carriage.

A preferred embodiment of the invention will be described hereinunder with reference to the drawing. A printer constructed in accordance with an embodiment of the invention, as shown in FIG. 1(*a*), has a die cast frame 1 having a guide ridge 2. A guide shaft 3 is attached to the frame 1. The guide ridge 2 and the guide shaft 3 cooperate with each other in holding a carrier 4 for free reciprocating motion. A daisy type wheel 5 as the type head is detachably secured to a carriage 6 which in turn is attached to the carrier 4. A daisy type wheel 5, as shown in FIG. 1(*b*), has a plurality of radially extending fingers 5*a* projected radially from a central hub 5*d*. Each finger 5*a* has a first and second plurality of characters 5*b*, 5*c* disposed thereon, the first plurality of characters 5*b* disposed a distance $r_1$ from the central hub 5*d*, the second plurality of characters 5*c* disposed at a distance $r_2$ from the central hub 5*d*, with a neutral position $r_3$ defined between the first plurality of characters 5*b* and the second plurality of characters 5*c*. A platen 7 is mounted substantially horizontally at the central portion. Printing paper 110 is inserted around the platen 7 by rotation of the platen 7 and is disposed to lie between the platen 7 and the daisy type wheel 5.

Figure 5:
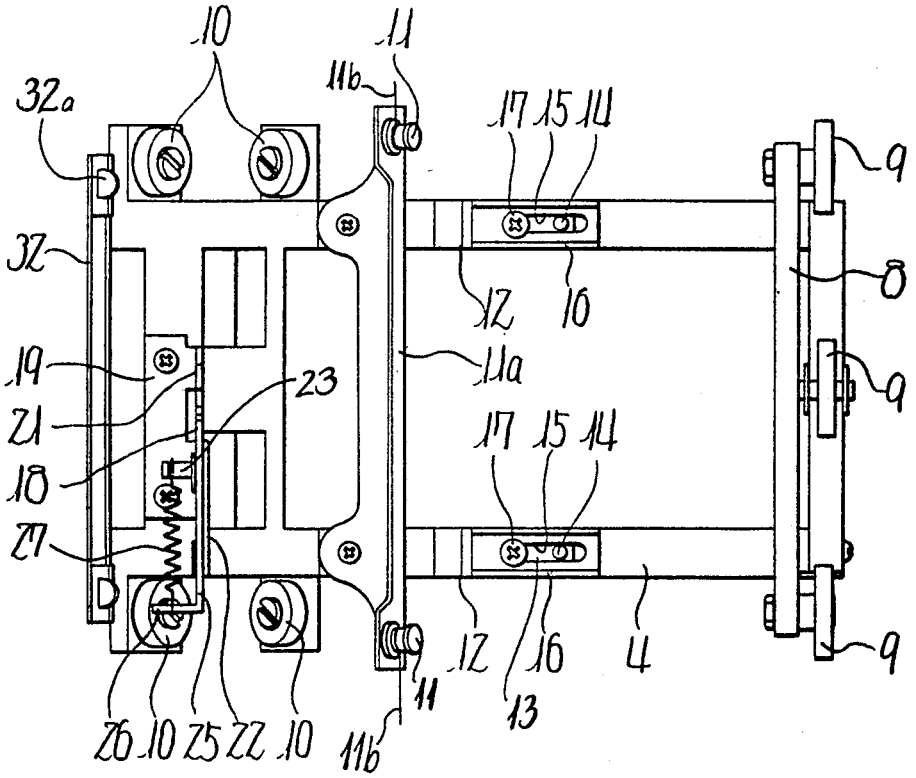
FIG. 5 is a plan view of a carrier.
Figure 6:
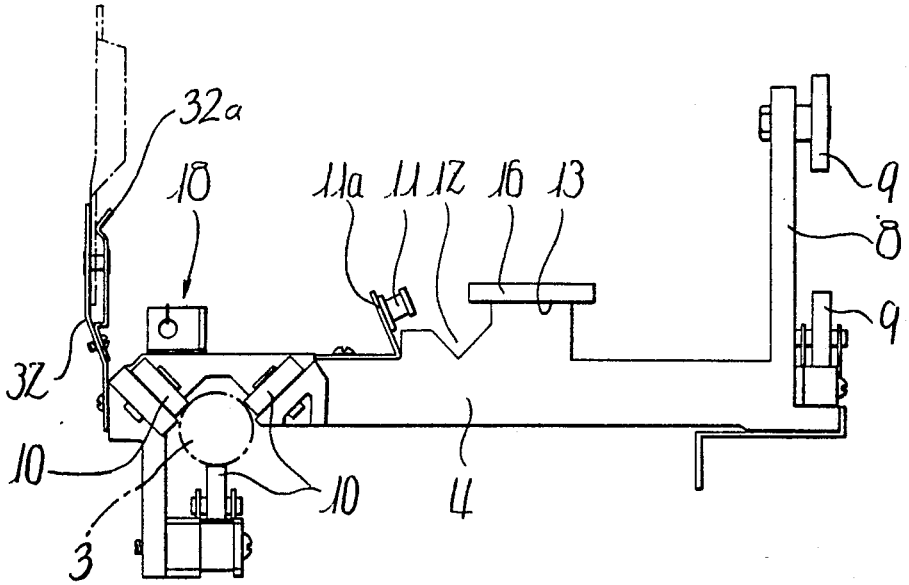
FIG. 6 is a side elevational view of a carrier.
Figure 7:
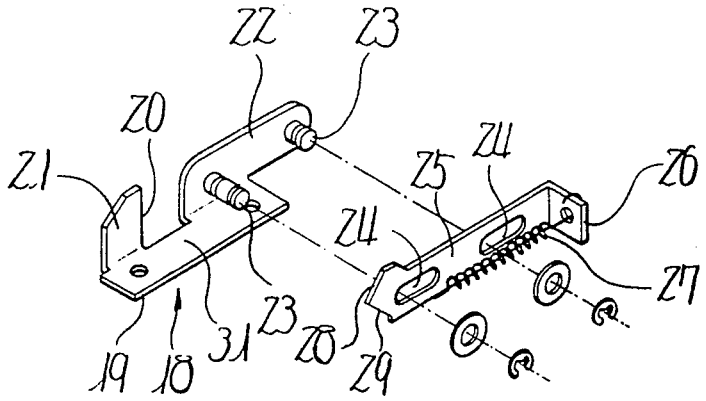
FIG. 7 is an exploded perspective view of a carriage set mechanism.
Figure 8:
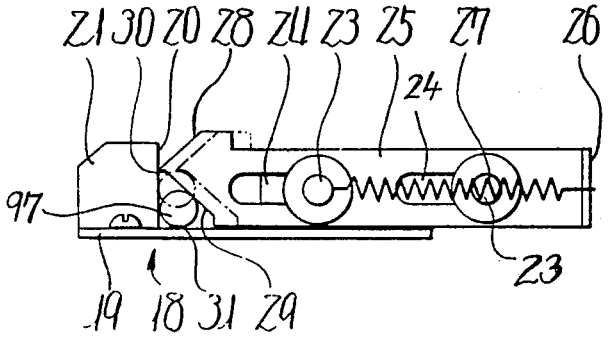
FIG. 8 is an enlarged front elevational view of a part of the mechanism shown in FIG. 7.
Figure 10:
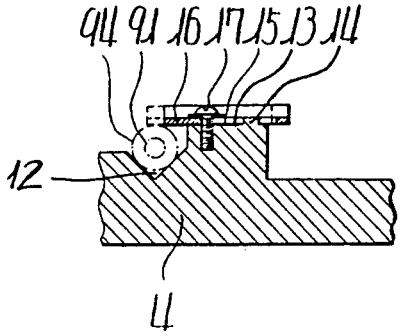
FIG. 10 is a vertical sectional side elevational view of a portion at which the carriage is secured to the carrier.

The carrier 4 (FIG. 5) is made by a die casting and has a substantially square frame-like configuration as viewed from the upper side, and is provided with an upright portion 8 standing upward from the rear end thereof. Three rollers 9 are attached to the upright portion 8 so as to contact the upper and lower edges of the guide ridge 2. Six guide shaft rollers 10 (FIG. 5) are attached to carrier 4 and circumferentially engaged the guide shaft 3. A driving plate 11*a* (FIG. 5) is provided at its both ends with pins 11 connected by driving wires 116 is attached to the central portion of carrier 4 (FIG. 5). Upwardly opening V-shaped notches 12, constituting the portions for engagement with the carriage 6, are formed substantially at the central portion of the carrier 4 in alignment with each other. A flat surface 13 (FIG. 6) behind the V-shaped notch 12 has a pin 14 (FIG. 5) fixed thereto. A holding member 16 having an elongated slot 15 for receiving the pin 14 is mounted on the flat surface 13 for free movement in the back and forth direction. This holding member 16 is fixed by means of a screw 17 so as to hold the shaft 91 (FIG. 10) of carriage 6. A carriage set mechanism 18 (FIG. 7) is provided at the front end of the carrier 4 (FIG. 6). More specifically, an L-shaped base plate 19 is secured to the carrier 4. A base piece 21 having a vertical reference surface 20 and a holding piece 22 spaced rearwardly from the base piece 21 by a distance corresponding to the plate thickness of a movable piece 25 described hereinbelow, are formed on the base plate 19. Two guide pins 23 are fixed to the holding piece 22 so as to extend forwardly therefrom. A movable piece 25 provided at one side of the holding piece 22 has a pair of horizontal elongated slots 24 for receiving the guide pins 23. The movable piece 25 is biased toward the base piece 21 by means of a tension spring 27 stretched between the forward guide pin 23 and a bent piece 26 at one end of the movable piece 25. Reference surface 20 forms a stop for the movable piece 25 (FIG. 8).

An end of the movable piece 25 (FIG. 7) adjacent to the base piece 21 is provided with upper 28 and lower 29 tapered surfaces which form a substantially V-shaped tapered tip. The lower tapered surface 29 is provided at its end with a small flat edge 30. The upper surface 31 of the base plate 19 constitutes a downward reference surface for the column-shaped engaging pin 97 (FIG. 8) which will be described later. The base plate 19, base piece 21, holding piece 22 and guide pins 23 collectively form a reference piece embodying the reference surfaces 20 and 31. A holding portion 32 (FIG. 5) for a card holder 32*a* constituted by a resilient plate is attached to the front surface of the carrier 4.

The carriage 6 is constituted by parts mentioned below assembled on a die cast main body 33. Namely, a motor 34 (FIG. 3) is attached to the lower end of the main body 33. A shift arm 37 (FIG. 13) rotatably held at its one end by a shaft 36 holds a drive shaft 35 which is connected to the shaft 34*a* of the motor 34 through a universal joint such as joint 26 in U.S. Pat. No. 4,106,611. A cross-shaped holding piece 38 (FIG. 2) for holding the petal-type type wheel 5 is attached to the end of the drive shaft 35. A magnetic member 37*a* (FIG. 13) is attached to the central portion of the arm 37 by conventional attachment means, shown herein as screws 37*b*. Magnets 39,40 are attached adjacent to the upper and lower sides of the magnetic member 37*a* by means of mounting screws 39*a*, 40*a*, respectively, engaging main body 33. Stoppers 41,42 are provided at the upper and lower sides of the arm 37 so as to limit the shift positions of the arm 37. The arm 37 (FIG. 13) is provided at its end with an engaging notch 43 engaged by a leaf spring 45 which is secured at its one end to the main body 33 by means of a screw 44. The leaf spring 45 and the arm 37 are split at their ends vertically to engage a guide piece 46 (FIG. 2) vertically fixed to the main body 33, to thereby prevent the oscillation in back and forth direction.

A hammer assembly 47 (FIG. 14(*a*)) is attached to the front and upper side of the main body 33. The hammer assembly 47 is constituted by a holder 48 made of a plastic or the like material, and a hammer 49 slidably held in the holder 48. The hammer 49 is always biased rearwardly by means 49*a* mounted in the holder 48 (FIG. 14(*b*)).

Figure 18:
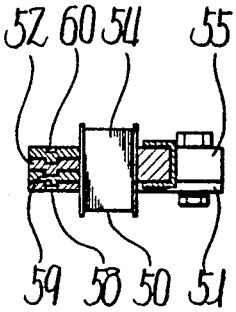
FIGS. 17 and 18 are sectional views of the magnet assembly.
Figure 17:
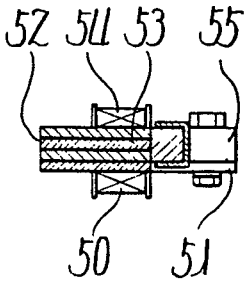

A magnet assembly 50 (FIG. 14(*a*)) is secured to the rear part of the thus constructed hammer assembly 47. This magnet assembly 50 is composed of an iron substrate 51 and a plurality of sheets of yokes 52 of silica steel laid thereon. Two leg-like cores 53 (FIG. 17) of the same shape are formed on the substrate 51 and the yokes 52, and coils 54 are wound round these cores 53. An armature 55 is rotatably attached to one end of the substrate 51 by means of an armature pivot plug 55*a*, while the other end of the armature 55 is provided with two stoppers 56 for limiting the range of rotation of the end of the armature 55. These stoppers 56 are constituted by eccentric shafts so that the position of the armature 55 is optimized by rotation and fixation of these eccentric shafts. The substrate 51 and the yokes 52 are provided with aligned through holes 57*a* receiving screws 57 (FIG. 14(*a*)) by means of which they are fastened to the main body 33. The substrate 51 and the yokes 52 are superposed in layers. In order to horizontally locate the substrate 51 (FIG. 18) and the yokes 52 in relation to each other, a hole 58 is formed in the substrate 51, while registration projections 59 and recesses 60 are formed by a knock-out process in the yokes 52. The horizontal positioning of the substrate 51 and the yokes 52 is achieved by making the projection 59 fit in the hole 58 and the recess 60.

Figure 21:
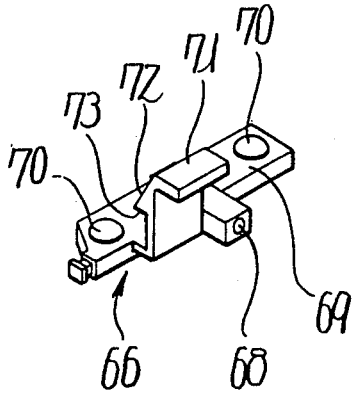
FIG. 21 is a perspective view of a ribbon cartridge holding member.

A ribbon cartridge attaching plate 61 (FIG. 3) having first and second side portions 61*a* is secured to the rear upper surface of the main body 33. A ribbon driving motor 62 (FIG. 4) is secured to the lower face of one side of the ribbon cartridge attaching plate 61. The ribbon driving motor 62 has a shaft 62*a* (FIG. 4) which is operatively connected to a ribbon driving shaft 63 (FIG. 3) by means of gears 62*b*, 62*c*, 62*d*. Furthermore, opposing support walls 64 are formed at both sides of the ribbon cartridge attaching plate 61 by bending. Support shafts 65 of the same length are fixed to the support walls 64 in axial alignment with each other. Each support shaft 65 rotatably carries a holding member 66 (FIG. 21) made of a resilient plastic material. A stopper ring 67 (FIG. 3) fitting to the support shaft 65 prevents the holding member 66 from dropping from the support shaft 65.

Figure 3:
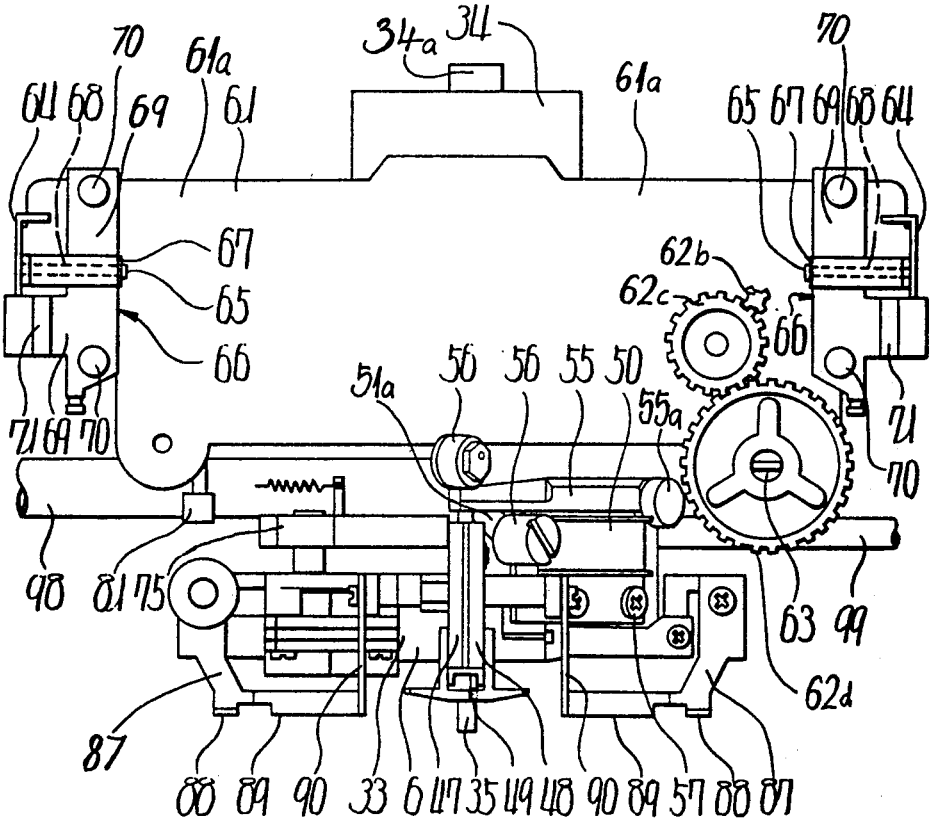
FIG. 3 is a plan view of the carriage.
Figure 4:
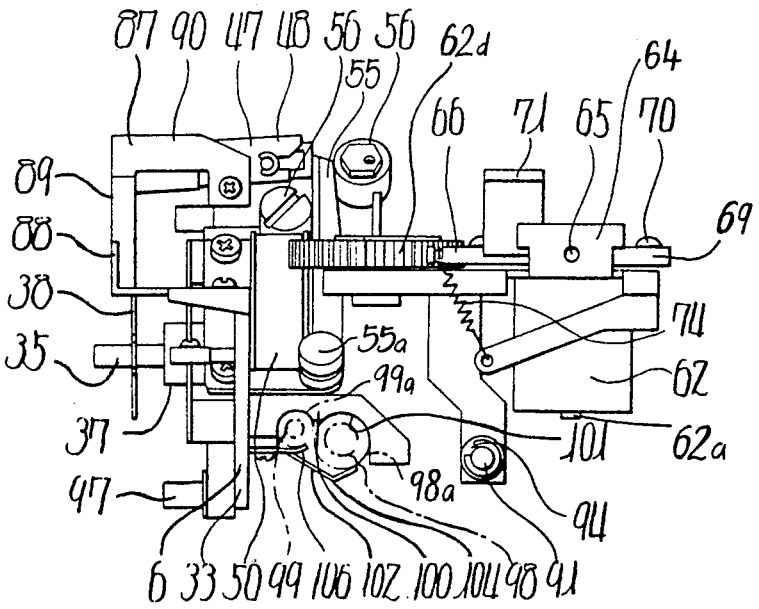
FIG. 4 is a side elevational view of the carriage.
Figure 19:
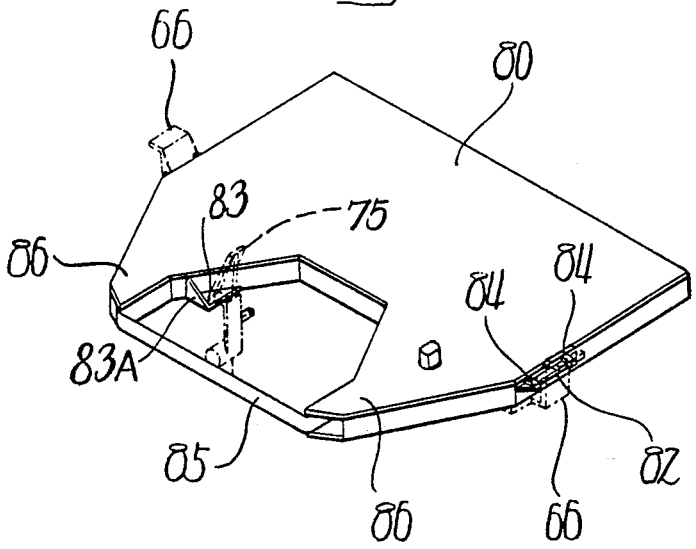
FIG. 19 is a perspective view of a ribbon cartridge.
Figure 20:
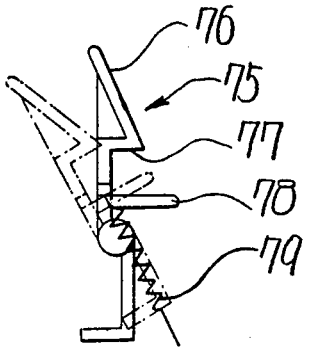
FIG. 20 is a rear elevational view of an upper stopper.

The holding member 66 (FIG. 21) is provided with resilient arms 69 extending toward both sides of the axial bore 68. A contact member 70 (FIG. 21) made of rubber or the like material is provided on the end of each arm 69 and is positioned directly beneath the ribbon cartridge 80 in operation and within the peripheral confines of the ribbon cartridge 80 and retaining lug 82 as best shown in FIGS. 2, 3 and 19. An elastic retaining tongue 71 is formed on the end of one of the arms 69, 69 unitarily with the arm 69. The retaining tongue 71 is provided at its upper end with a tapered surface 72 and a retaining projection 73. The holding member 66 (FIG. 4) is biased by a tension spring 74 such that its front part is urged downwardly. In addition, an upper stopper 75 (FIGS. 19, 20) for engaging the front part of the ribbon cartridge 80 is rotatably secured to the central portion of the main body 33. The upper stopper 75 is constituted by a tapered surface 76, engaging step 77 and a lug 78, and is adapted to take either a holding position or releasing position by the action of the toggle spring 79.

A push-up lever 81 (FIG. 3) provided on the main body 33 is adapted to set the ribbon cartridge 80 in an upwardly directed position. The ribbon cartridge 80 has a substantially U-like form each side of which is provided with a retaining lug 82 (FIG. 19) for engagement with the retaining lug 73 (FIG. 2) of the holding member 66, as well as an engaging portion 83 (FIG. 19) for engagement with the upper stopper 75. A support wall 84 for determining the position of the retaining lug 73 in the back and forth direction is formed at each of front and rear sides of the retaining lug 82. The cartridge 80 accommodates an ink ribbon 85 in the form of an endless belt. The ink ribbon 85 is led out of the cartridge 80 through the end of a front leg 86.

A ribbon guide 87 (FIGS. 2 and 4) is provided at each side of the hammer assembly 47 on the main body 33. The ribbon guide 87 is fixed at its both ends to the main body 33 and is provided at its lower front part with a lug 88 for receiving the holding portion 32 of the card holder 32*a*. Also, a ribbon guide surface 89 for guiding the ribbon 85 and a grip portion 90 are formed as the central portion and upper portion, respectively, of the ribbon guide 87.

Figure 9:
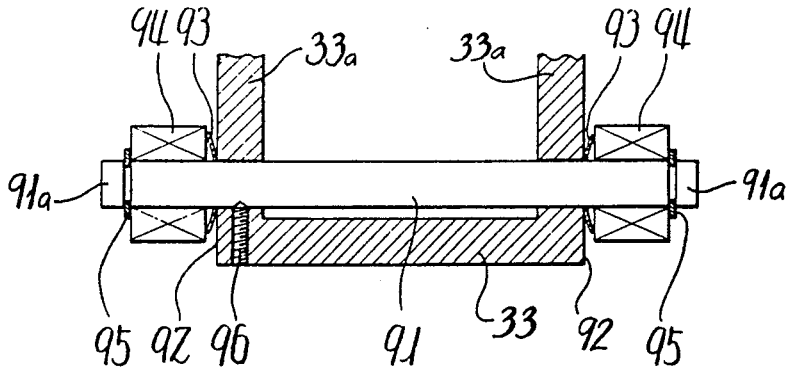
FIG. 9 is a vertical sectional view of the supporting portion of the carriage.

A support shaft 91 (FIGS. 4 and 9) having end portions 91*a* and constituting the rotation fulcrum is extended through and fixed to the central lower part of the main body 33 through side walls 33*a*. A corrugated washer 93 is placed together with a bearing 94 between the support shaft 91 and the side surface 92 of the main body 33 which is penetrated by the support shaft 91, at each side of the main body 33. These bearings 94 are prevented from dropping, by means of stopper rings 95. The support shaft 91 is prevented from moving in the right and left directions by means of screw 96. Engaging pin 97 for engagement with the carriage set (attachment) mechanism 18 is formed to project from the central front part of the main body 33.

Figure 11:
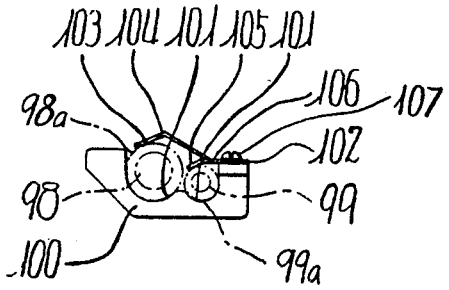
FIG. 11 is a vertical sectional view of a wire retaining portion.
Figure 12:
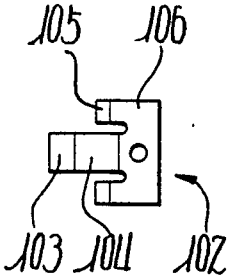
FIG. 12 is a plan view of a wire retaining member.

In addition, the carriage 6 is provided with a lead drive wire 98 (FIG. 4), as well as a lead control wire 99. In order to avoid the mutual interference between these wires 98,99 these wires 98,99 are separated into the group of drive system wire 98 (FIG. 11) and control system wire 99 covered by shields 98*a*, 99*a* (FIGS. 4 and 11) in the form of closely contacting coils. The drive system wire 98 and the control system wire 99 fit in arcuate recesses 101 of a holder 100 made of an electrically insulating material and fixed to the main body 33, and are fastened by means of a wire retainer 102 (FIGS. 11 and 12). The wire retainer 102 is made of a resilient material of thin steel sheets or the like, and is shaped to have a mountain-like form. More specifically, the retainer 102 has a central retaining portion 104 provided at its end with a bend 103 and adapted for retaining the driving system wire 98 having the larger diameter, as well as a side retaining portion 106 having end bend 105 and adapted for retaining the control system wire 99 of smaller diameter. The retainer 102 is fastened at its base end to the holder 100 by means of a screw 107 (FIG. 11).

In the above-described construction, the carrier 4 is reciprocatably secured to the frame 1 and detachably carries the carriage 6. To explain in more detail, the bearing 94 (FIGS. 4 and 10) of the support shaft 91 is fitted in corresponding V-shaped notch 12 (FIG. 6) and is temporarily fastened in such a manner as to be able to move in the left and right directions. As the grip portion 90 (FIG. 2) is depressed at its front end, the engaging pin 97 comes into contact with the reference surface 31 while forcibly moving the movable piece 25 of the carriage set mechanism 18. Therefore, the carriage 6 is precisely located in the vertical and horizontal directions, and the bearing 94 is securely fixed by the holder 16 thereby to complete the attaching of the carriage 6 to the carrier 4.

Since the bearing 94 is stopped at its both ends by stopper rings 95 and since the dimensional error of the distance between both side surfaces 92 of the main body 33 is absorbed by the corrugated washers 93, it is possible to precisely locate the carriage 6 without substantial fine adjustment. Therefore, the replacement of the petal-type type wheel 5 can be made easily by pulling the grip portion 90 upward to cause rotation of the carriage 6 into a vertical posture around the support shaft 91. Similarly, the resetting can be achieved simply by depressing the grip portion 90. In this state, the flat edge 30 of the movable piece 25 provides a desirable feel by clicking when the carriage 6 is turned upward. In addition, in the case where the line change is performed by a slight pushing up of the carriage 6, jumping of the carriage 6 due to inertia is avoided.

For mounting the ribbon cartridge 80 (FIG. 19), the holding member 66 is deflected as it is simply pressed upward, to bring its retaining projection 73 (FIG. 2) into engagement with the retaining lug 82, to thereby set the ribbon cartridge 80. At whichever position, holding or releasing, the upper stopper 75 (FIG. 20) may be, the engaging portion 83 of the ribbon cartridge 80 makes contact with the tapered surface 76 to create a releasing state or, if a releasing state has been created already, engaging portion 83 contacts the lug 78 to position the engaging step 77 at the upper part of the engaging portion 83. In this state, a predetermined constant distance is preserved between the engaging portion 83 and the engaging step 77. During the printing operation, the front part of the ribbon cartridge 80 is pushed up by the push-up lever 81 (FIG. 3). In this state, the engaging portion 83 contacts the engaging step 77 so as to be prevented from moving further upward. It will be seen that only the ribbon cartridge 80 itself and the holding member 66 move during the up and downward shifting of the ribbon cartridge 80, so that the moving mass is sufficiently small to suppress the generation of vibration.

Figure 13:
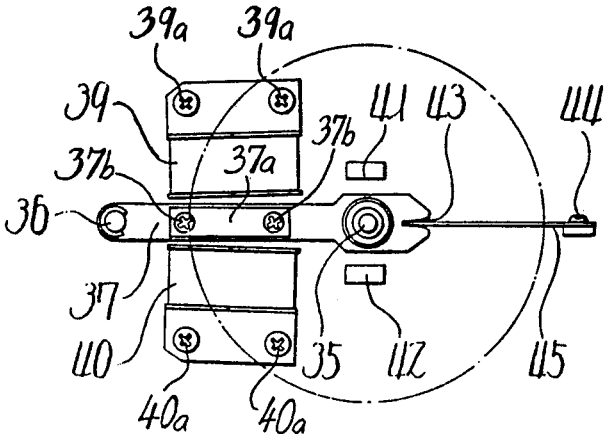
FIG. 13 is a front elevational view of a drive shaft shifting mechanism.
Figure 15:
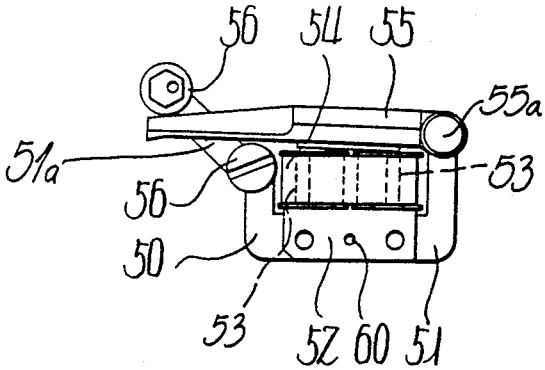
FIG. 15 is a plan view of a magnet assembly.
Figure 16:
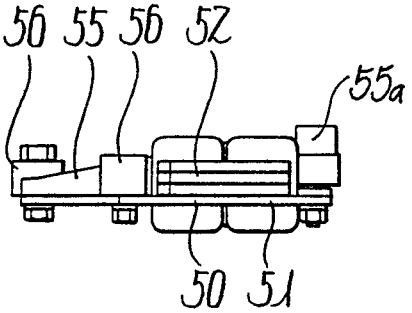
FIG. 16 is a sectional view of a hammer assembly.

The shift of the daisy type wheel 5 is made by selective energization of the magnets 39, 40 (FIG. 13). More specifically, the arm 37 is rotated upward to make the petal-type type wheel 5 take the upper position $r_1$ in alignment with hammer 49 as the upper magnet 39 is energized, whereas, when the lower magnet 40 is energized, the arm 37 is rotated downward to set the daisy type wheel 5 at the lower position $r_2$ in alignment with hammer 49. As a result, the peripheral position of the hammer 49 is apparently changed to create the state of vertical shift of the daisy type wheel 5, to permit the printing of characters the number of which is twice as large as the number of fingers of the daisy type wheel 5. With magnets 39, 40 unenergized, the arm 37 is biased to the neutral position so that $r_3$ is in alignment with hammer 49 by the leaf spring 45, so that it is required that the leaf spring 45 has a small spring constant and exhibits a constant spring force in acting in both the up and downward directions, in order that up and downward shifts of the daisy type wheel 5 are made at a good balance, considering that the magnets 39,40 have comparatively small capacities. Needless to say, in view of the weights of the parts concerned, the neutral position $r_3$ is slightly offset from the midpoint between two magnets 39 and 40. Therefore, the directing of the leaf spring 45 toward the neutral point $r_3$ can easily be achieved by setting beforehand the direction of major surface of the attaching portion. Since the leaf spring 45 takes a neutral position in the free state and since the spring constant acts only primarily during deflection, the magnets 39, 40 need not have large attracting forces and no fluctuation is caused either in upward or downward shifting directions.

Thus, the electric current is supplied either to the magnet 39 or to the magnet 40 during the printing operation. As the coil 54 is energized in this state, the armature 55 is attracted to strike the hammer 49 to impact the ink ribbon 85 and the printing paper 110 on which the printing is to be made which are located between the petal-type type wheel 5 and the platen 7, through the medium of the type wheel 5, to make the printing.

It is essential that the relative position between the hammer 49 and the armature 55, as well as the stroke relation, is set correctly, in order to achieve the above-described printing operation at a desired accuracy. The position of the hammer 49 in relation to the main body 33 is previously determined by setting the position of the hammer assembly 47. Therefore, only the hammer stroke has to be set by an adjustment. This can be achieved by the magnet assembly 50. Namely, in the assembling of the magnet assembly 50, the range in which the armature 55 can operate with highest efficiency, as well as the operation angle of the same, can be adjusted solely in the magnet assembly 50, by an adjustment of the stopper 56.

Therefore, this adjustment of the hammering stroke is completed by an assembly setting sequence such that the magnet assembly 50 takes the correct position in relation to the hammer 49, when the magnet assembly 50 is secured to the main body 33 by means of screw 57. Since only one adjustment of position setting of the magnet assembly 50 is required, the assembly work can be finished easily and promptly.

The drive system wire 98 and the control system wire 99, each having a plurality of lines, are secured at their base portions by means of the wire retainers 102. Since the holder 100 cooperating with the wire retainer 102 have two arcuate recesses 101 formed in close proximity of each other, these wires 98, 99 of the two systems are retained with their peripheral surfaces in clsoe contact with each other, so that only a small space is required for the wires 98,99 around the wire retaining portion. This offers a great advantage in handling of the wires 98, 99, particularly in an apparatus of this kind having limited wire passage space.

Therefore, the space occupied by the wires 98, 99 is greatly reduced as compared with that in the conventional system in which the wires are secured one by one or the wires are fastened by means of screws placed between adjacent wires. This provides a remarkable effect in reducing the breadth of the reciprocatable carriage 6 which in turn greatly diminishes the overall size of the apparatus as a whole.

In addition, since two wires 98,99 are simultaneously retained by a single part, the number of parts is reduced and assembly of the printer is greatly facilitated.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A printer comprising:

a frame;

a carrier reciprocatably mounted on said frame;

a carriage having a detachable print wheel; and means for pivotally mounting said carriage on said carrier for selective pivoting between a first operational position wherein said carriage is held in place and a second released position for exchanging said print wheel; wherein said carriage further comprises an engaging pin;

said carrier further comprises a movable piece resiliently mounted thereon and at least one reference surface;

said movable piece further comprises a first tapered surface for contacting said engaging pin to displace said movable piece when said carriage is pivoted toward said first position and a second tapered surface for forcing said engaging pin against said at least one reference surface when said carriage is in said first position during operation of said printer to restrain movement of said carriage with respect to said carrier; and wherein holding and releasing of said carriage with respect to said carrier may easily be achieved by engaging said carriage and moving said carriage.

2. A printer as set forth in claim 1, wherein said at least one reference surface further comprises a horizontal reference surface for contact with said engaging pin;

said printer further comprises a platen; and said horizontal reference surface and said engaging pin further comprise means for establishing proper vertical alignment of said carriage with respect to said platen.

3. A printer as set forth in claim 2, wherein said carrier further comprises a vertical reference surface, and wherein said vertical reference surface and said engaging pin further comprise means for establishing proper longitudinal alignment of said carriage with respect to said platen.

4. A printer as set forth in claim 3, wherein said means for pivotally mounting said carriage further comprises at least one support shaft, bearing means mounted on said support shaft and means for detachably receiving said bearing means; and said means for pivotally mounting said carriage further comprises means for establishing proper radial positioning of said carriage with respect to said platen.

5. A printer as set forth in claim 3, wherein said movable piece further comprises a plate-like member slidingly mounted on said carriage for movement toward and away from said vertical reference surface;

said first and second tapered surfaces of said movable piece further comprise a substantially V-shaped tapered tip disposed at an end of said plate-like member; and said resilient mounting of said movable piece further comprises means for biasing said tapered tip toward said vertical reference surface.

6. A printer as set forth in claim 1, wherein said carrier further comprises a reference piece on which is disposed said at least one reference surface, and wherein said resilient mounting of said movable piece further comprises a spring connected between said reference piece and said movable piece.

7. A printer as set forth in claim 1, wherein said carrier further comprises a stop for said movable piece and wherein said resilient mounting of said movable piece biases said movable piece toward and against said stop.

8. A printer as set forth in claim 1, wherein said carrier further comprises at least two reference surfaces and wherein said second tapered surface of said movable piece further comprises means for forcing said engaging pin against both of said at least two reference surfaces when said carriage is in said first position.

9. A printer as set forth in claim 8, wherein said at least two reference surfaces are mutually orthogonal.

* * * * *